US005921406A

United States Patent [19]

Leone

[11] Patent Number: 5,921,406

[45] Date of Patent: Jul. 13, 1999

[54] PASSIVE PAPER STACKER

[76] Inventor: Patrick Leone, P.O. Box 1604, Monroe, Mich. 48161

[21] Appl. No.: 08/799,150

[22] Filed: Feb. 14, 1997

[51] Int. Cl.[6] ..... A47F 7/00

[52] U.S. Cl. ..... 211/50

[58] Field of Search ..... 211/50, 59.2; 206/425

[56] References Cited

U.S. PATENT DOCUMENTS

| | | | |
|---|---|---|---|
| 710,655 | 6/1902 | Widenhofer | 211/50 |
| 714,137 | 11/1902 | Branch | 211/50 |
| 812,634 | 2/1906 | De Witt et al. | 211/50 |

*Primary Examiner*—Alvin Chin-Shue
*Assistant Examiner*—Sarah Purol
*Attorney, Agent, or Firm*—The Law Offices of William McNeir Richmond, P.C.; Chad M. Herring

[57] ABSTRACT

A passive paper stacker is disclosed for stacking large quantities of paper in a correctly collated order without the need for an externally powered motor. The stacker does not require any outside power source beyond the force of gravity acting on the paper itself. The paper enters the stacker with printed side facing upwards, the paper is pulled by the force of gravity acting on it down a slide ramp and into a radiused ramp oriented to flip the paper such that it is now facing with the printed face down. The paper then passes under a plurality of fingers and enters a paper tray where it is stacked on top of previously printed sheets of paper. The invention thus yields a stack with the first printed sheet at the bottom, the last printed sheet at the top, and each sheet having the printed side face down. When it is flipped over, the resultant stack is oriented in proper collated order: the first printed sheet on top, the last printed sheet on the bottom, and each sheet having printed face up.

12 Claims, 5 Drawing Sheets

PASSIVE PAPER STACKER

TECHNICAL FIELD OF THE INVENTION

This invention relates generally to a device for stacking individual sheets of paper from a printing device without the use of a motor and in a correctly collated order.

BACKGROUND OF THE INVENTION

In recent years laser printers, facsimile machines, image duplicating machines, thermal imaging devices and other printing devices have come to enjoy widespread use in both offices and homes throughout the modern world. At the present time, most of these printing devices employ individual sheets of paper ("cut-sheets") of various sizes. The most common of these sizes are 8.5 inches by 11 inches (standard size) and 8.5 inches by 14 inches (legal size). Many of these devices allow for discharging of the printed sheets of paper from an output source on the front, back, or sides of the device into a low capacity paper tray, with the printed side of the sheet facing upwards. As such the printed papers are successively discharged from the printing device with the printed side of the paper facing upwards. The stack resultant is not properly collated. The first sheet printed is at the bottom of the stack and the last sheet printed is at the top and the printed sides of each sheet are facing up. This resulting stack contains the last page printed on top and the first page printed on the bottom. For proper collation to occur, the sheets of paper must be individually restacked by the user into the proper collated order.

Due to the difficulties encountered with the low paper capacity of the paper tray attached to the printer and the inconvenience of having to individually restack the printed sheets into their proper order, printing devices many times are equipped with electrically powered mechanically driven output stackers. The job of these stackers is to stack large amounts of printed paper in a properly collated order. Current powered stackers are expensive, require frequent maintenance and are in many cases unreliable and prone to malfunction and jamming. Thus a need exists for a low-cost, reliable, high capacity, output paper stacker that is capable of collating the individual sheets paper in their proper order.

Accordingly, the principle object of the present invention is to provide a low-cost, reliable, non-motorized or "passive" paper stacker.

A further objective is to provide a passive paper stacker that will stack the printed paper in a stable and collated stack.

A further objective is to provide a passive paper stacker that has the capability for effectively stacking up to 3000 sheets of cut-sheet paper.

A further objective is to provide a passive paper stacker that can handle both standard and legal sized paper of varying weights, while remaining resistant to paper jams and operating without human supervision.

Additional objectives, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations pointed out in the claims.

SUMMARY OF THE OF INVENTION

According to the present invention, the foregoing and other objects and advantages are best obtained by a passive paper stacker that is able to stack a long series of individual sheets of paper in collated order. The present invention takes advantage of gravity to move individual sheets of paper having printing on their top face from a paper output on the front, back or side of a printing device, down an angled slide ramp. The force of the paper leaving the printing device alone in combination with the force exerted on the sheet of paper by gravity, allows the sheet to slide into a mouth opening and down the angled ramp. The force of gravity alone acting on the paper causes it to increase in speed as it travels down the angled ramp. At the distal end of the angled ramp, the paper passes into a radiused ramp. The radiused ramp is oriented to flip the paper so that the printed face is now facing down for proper collation. Now oriented with the printed face down, the paper slides through the radiused ramp. At the discharge end of the radiused ramp, the paper slides under a plurality of fingers which cause rate of speed of the paper to rapidly decrease. The sheet of paper drops into the receiving tray, printed side facing down for proper collation. The receiving tray is supported by springs that are precision manufactured to provide a linear rate of drop or extension to the receiving tray as the weight of the paper in the tray increases. This assures that the entry level of the paper sliding into the receiving tray will remain constant. To clarify, the height of the receiving tray will decrease at such a rate that the distance that the paper travels from the discharge end of the radiused ramp to the receiving tray remains constant as the height of the stack of paper in the tray increases. The resulting stack of paper has the first sheet printed on the bottom, the last sheet printed on the top, and the printed side of each sheet of paper facing downward. This entire stack merely needs to be flipped upside-down to be in properly collated order with the printed face up with the first sheet printed on top and the last sheet printed on the bottom. Thus the entire stack can be removed from the receiving tray by the user flipped upside-down in one step. The present invention thus greatly reduces the amount of effort required to attain a properly collated stack of printed paper from a printing device, while maintaining the quality and reliability of the device. Further, the only operator supervision that is required is to flip the final stack upside-down. The invention is thus capable of handling large quantities of paper virtually without human supervision.

In the present embodiment the invention is constructed from a wire skeleton, with formed sheet-metal sides. This combination has been found superior in resistance to the build-up of static electricity within the invention and the reduction of the occurrence of paper jams. The main body of the invention consists of a wire frame with a plurality of vertical and horizontal wires for support. The sheet metal side pieces are attached to this frame and comprise the sides of the paper receiving area. The sheet metal sides also support the springs which in turn support the vertical receiving tray. The sheet metal sides are fitted over the frame to cover and support the springs. In the preferred embodiment the sheet metal sides are removable from the frame. In this way, the build-up of static electricity and the overall weight of the stacker are minimized, while the reliability and transportability of the stacker are maximized.

In accordance with another aspect of the invention, it is critical that the slide ramp be oriented at an angle that is adequate to give the paper sufficient speed to pass through the radiused ramp without jamming. If the individual sheets of paper attain too great a speed from the angle of the slide ramp, they will exit the radiused ramp unevenly and form an uneven stack in the receiving tray. If the individual sheets of paper do not attain great enough speed from the slide ramp, they will cause the paper to jam in the radiused ramp.

In accordance with another aspect of the invention, it is critical that the radiused ramp have a radius sufficiently long enough to ensure that the cut-sheet paper will exit the radiused ramp and fall onto the paper tray to form a neat and orderly stack. If the radius is too long, the stack of paper will jam at the discharge end of the radiused ramp. If the radius is not long enough the paper will not form an even stack.

In accordance with another aspect of the invention, it is critical that the fingers be of such a length and weight that the rate of speed of the paper is slowed sufficiently to yield a neat output stack. If the fingers slow the rate of speed of the paper too much, the paper will not fully exit the radiused ramp and a jam will result. If the fingers do not slow the rate of speed of the paper enough, the paper will form an uneven and uncontrolled stack. In the present embodiment, the fingers are slim strips of sheet metal or spring steel and provide a braking solution for the paper as it enters the paper tray. If the fingers are removed or are not precisely sized and weighted, the passive stacker is unacceptable due to sloppy or uneven paper stack.

In sum, the relationships between the length and angle of the slide ramp, the length and radius of the radiused ramp, and the weight and length of the fingers are critical to both attaining a proper paper stack and building a functioning machine. Research has shown that there is no definite formula to define the exact nature of this relationship. However, the inter-relationships between these critical variables are clearly definable. This is to say that the decrease in paper speed resulting from decreasing the angle of the slide ramp can be negated by increasing the length of the slide ramp. Similarly, the increase in paper speed due to increasing the length and angle of the slide ramp can be negated by increasing the length and weight of the fingers or decreasing the radius of the radiused ramp. Thus, given a specific paper size and weight, there are a number of combinations of the critical variables that will result in the proper functioning of the invention.

In accordance with another aspect of the invention, the passive stacker includes a receiving tray supported by a plurality of springs. The springs are machined to increase in length at a linear rate when acted upon by the weight of the paper tray such that the distance between the top sheet of paper on the tray and the discharge end of the curved ramp remains constant as successive sheets of paper are added to the paper tray. In addition to the nature of the springs, the placement of the springs is also critical. If the springs are not positioned to evenly distribute the load, any inconsistency in the stack will cause the receiving tray to tip forward or backward during the descent. In the extreme, this will cause the stack to topple. The receiving tray is further secured within the main body by a shelf retainer. This retainer further prevents the receiving tray from tilting forward and spilling the output stack.

In accordance with another aspect of the invention, the passive paper stacker may stand on legs or on casters allowing the entire unit to be rolled to a desired location.

Still other objects and advantages of the invention will become readily apparent to those skilled in this art from the following detailed description, wherein we have shown and described only the preferred embodiment of the invention. As will be realized, the invention is capable of other and different embodiments, and its several details are capable of modifications in various obvious aspects, all without departing from the invention. Accordingly, the drawing and description are to be regarded as illustrative in nature, and not as restrictive.

BRIEF DESCRIPTION OF DRAWINGS

The foregoing summary, as well as the following detailed description of a preferred embodiment of the invention, will be better understood when read in conjunction with the appended drawings. For purposes of illustrating the invention, there is shown in the drawings an embodiment which is presently preferred. It should be understood, however, that the invention is not limited to the precise arrangement and instrumentality shown. In the drawings.

DETAILED DESCRIPTION OF THE INVENTION

Figure 1:
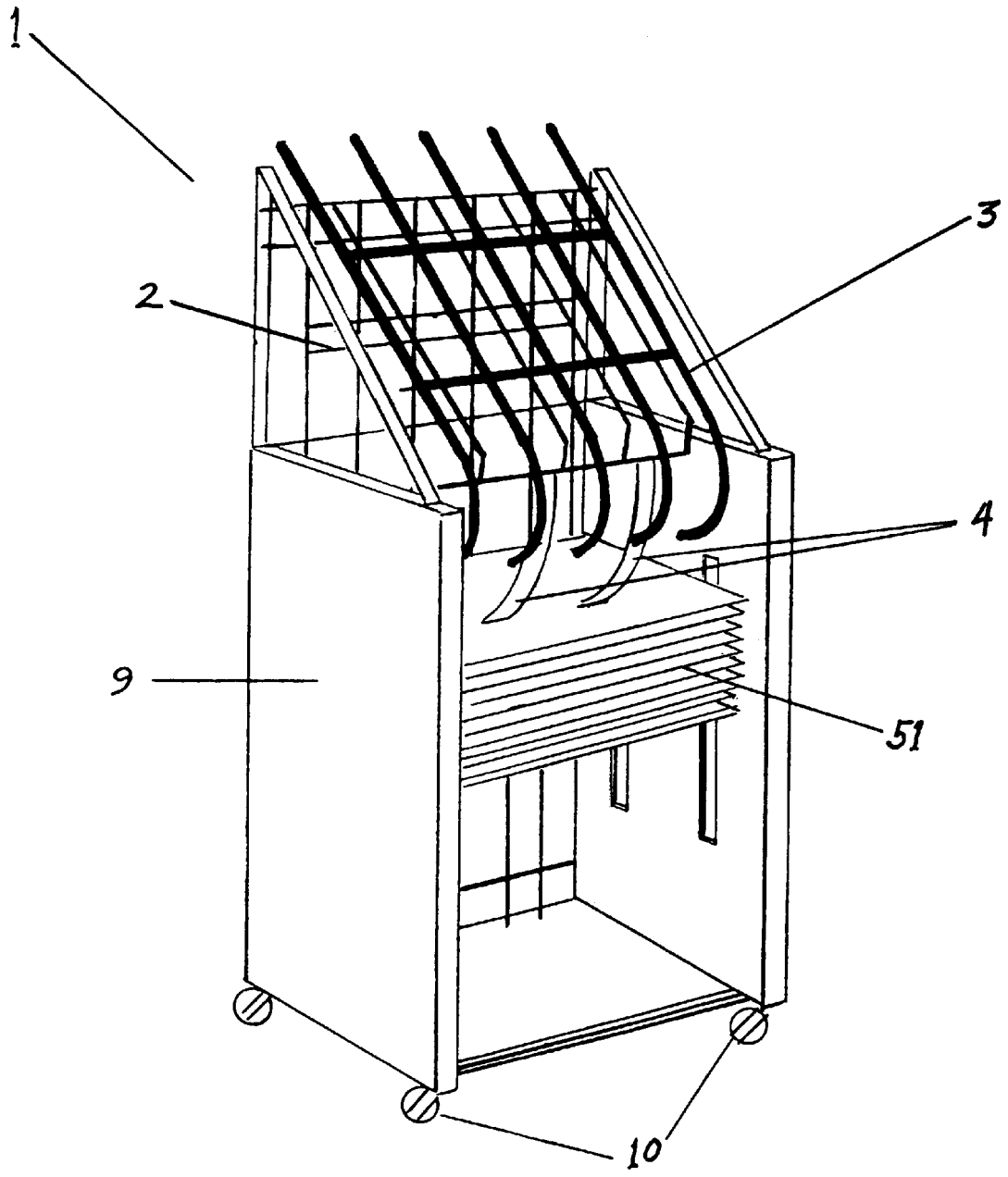
FIG. 1 is a perspective view of a passive paper stacker that incorporates the invention hereof.

Reference will now be made in detail to the present preferred embodiment of the invention, an example of which is illustrated in the accompanying drawings. Referring now to the drawings, wherein similar reference characters designate corresponding parts throughout the several views, as shown in FIG. 1, the invention is a passive paper stacker that functions under the force of gravity to allow single sheets of paper, discharged from the output of a printing device with the printed side of the page facing up, to be successively stacked and properly collated with the printed side of the page facing down by means of a slide ramp, a radiused ramp and a receiving tray.

Figure 2:
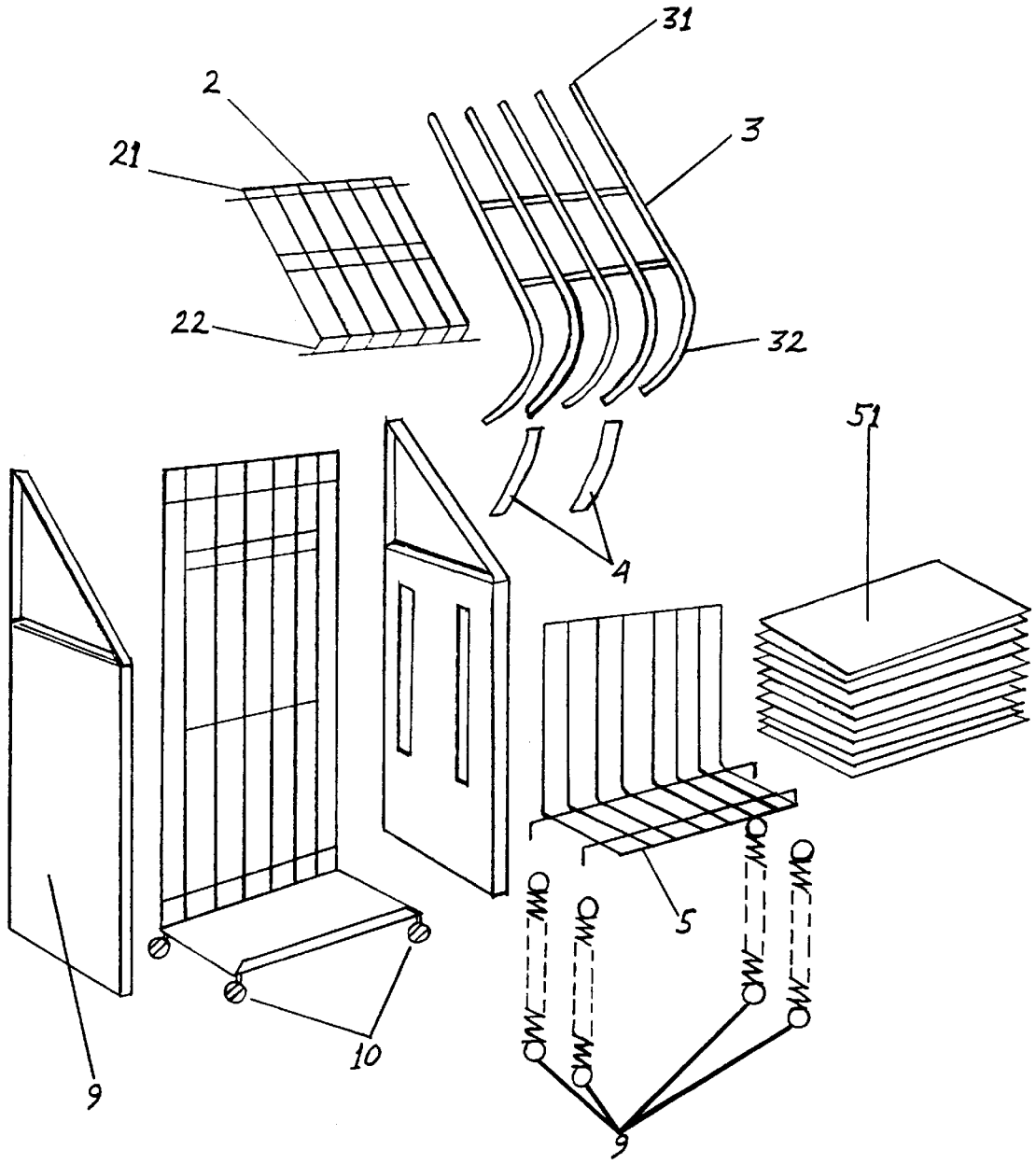
FIG. 2 is an exploded perspective view of FIG. 1 showing the various elements of the passive paper stacker that incorporates the invention hereof.
Figure 3:
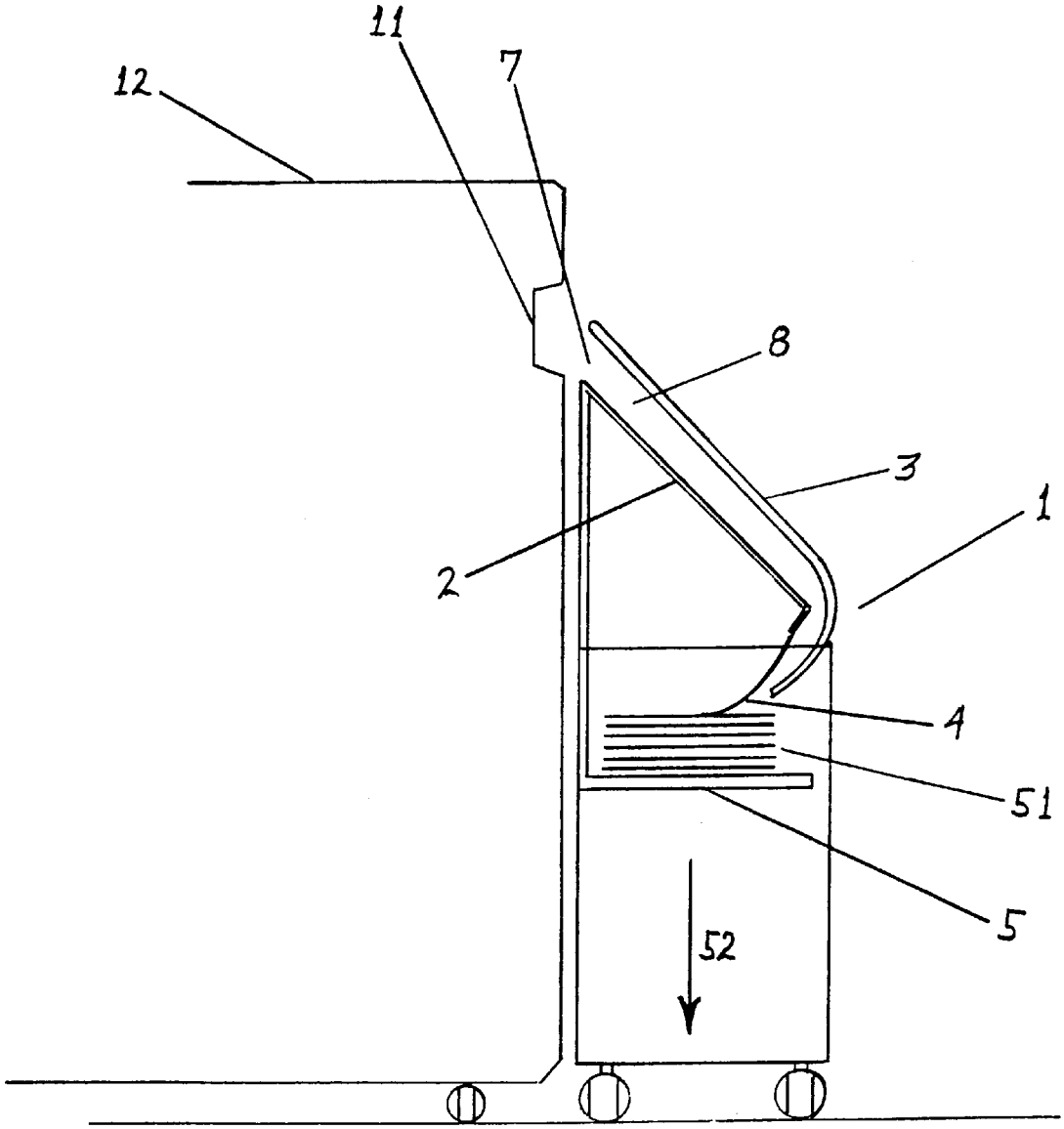
FIG. 3 is a cut away view of the passive paper stacker that incorporates the invention hereof depicting the passive paper stacker in working relation to the paper output of a printing device.
Figure 4:
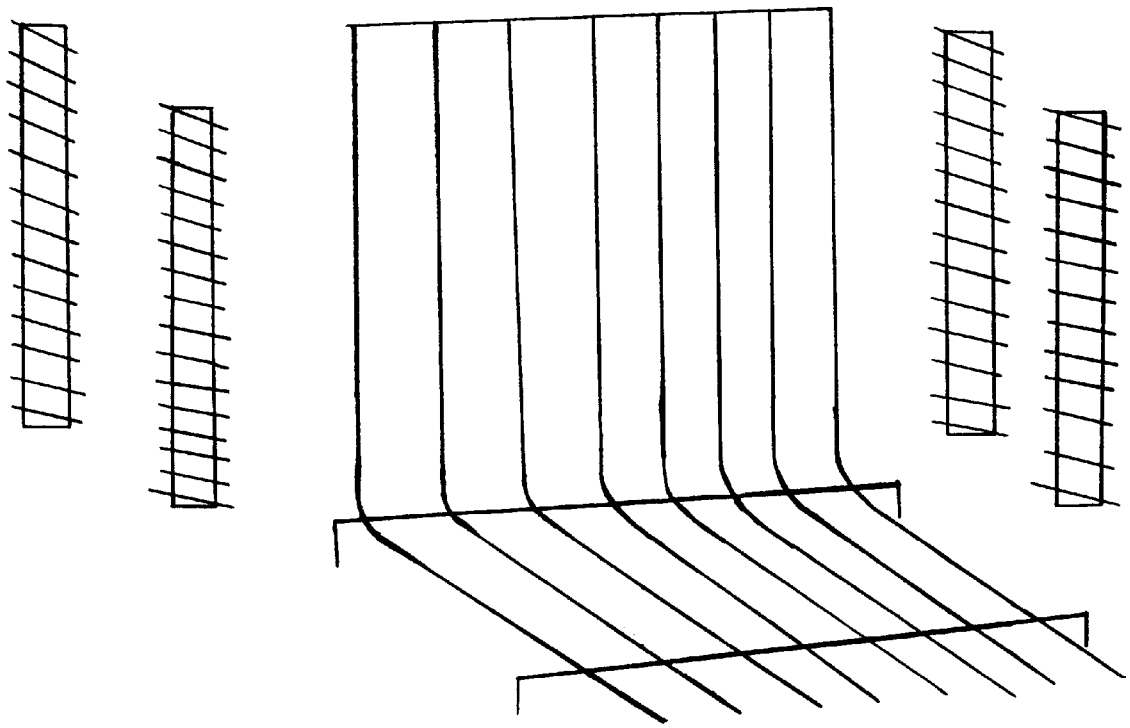
FIG. 4 is a perspective view of the receiving tray.
Figure 5:
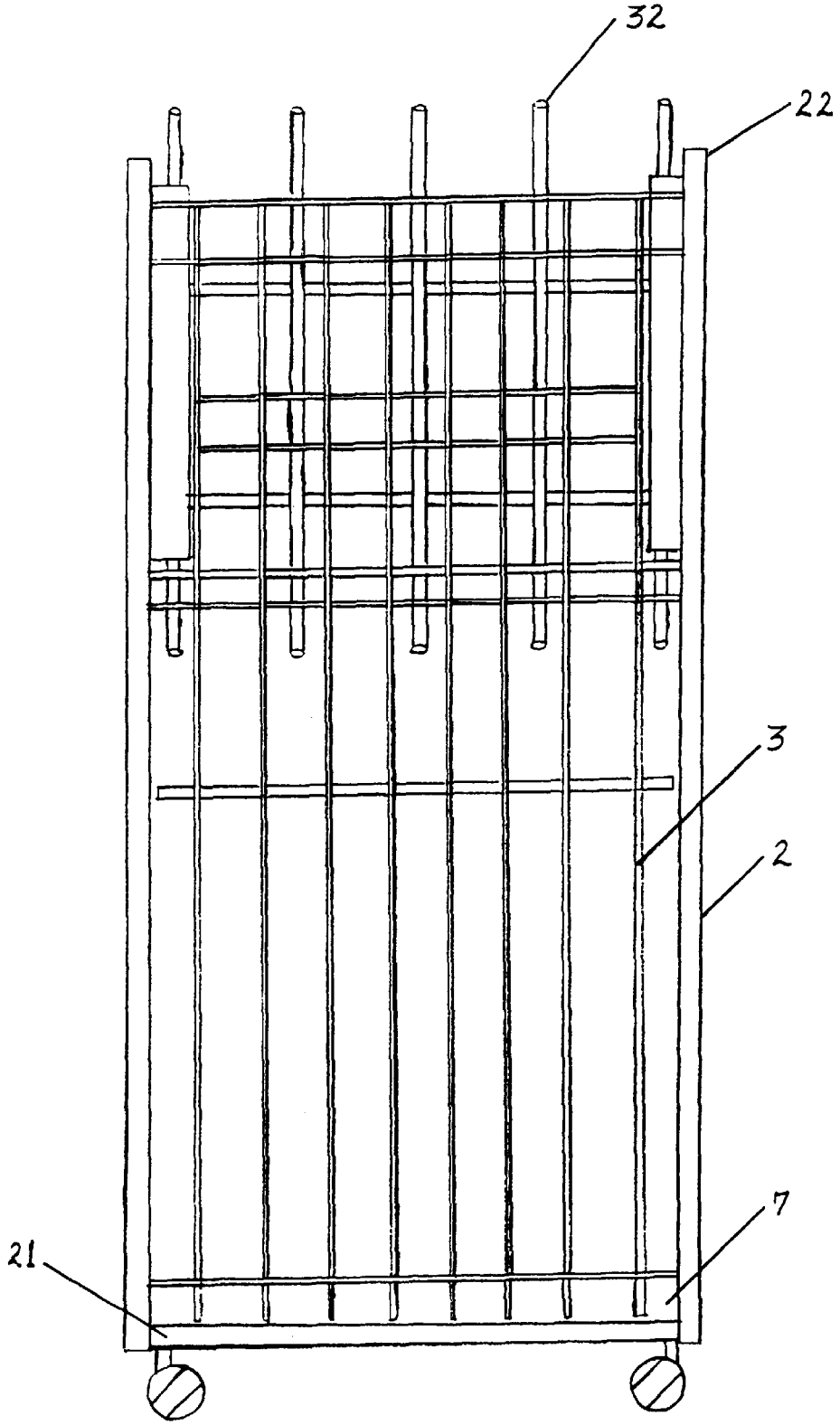
FIG. 5 is a top view of the radiused ramp and the angled ramp in working relation to each other.

In accordance with the illustrated embodiment of the invention in FIGS. 1–3, the passive paper stacker 1 is comprised of an angled slide ramp 2, a radiused ramp 3 having a plurality of fingers 4 positioned thereon, and a receiving tray 5 supported by a plurality of springs. After being discharged from the paper output 11 of a printing device 12, the individual cut-sheets of paper enter the passive paper stacker via opening 7. The angled slide ramp 2 has a proximal end 21 positioned immediately adjacent to the opening 7 and a distal end 22 over which the paper sheet passes as it travels into the radiused ramp 3. The distal end 22 of the angled ramp 2 and the entry end 31 of the radiused ramp 3 overlap to form a paper passage 8 through which the sheets of paper pass as they slide downward towards the receiving tray 5. The angled ramp and the radiused ramp are constructed of a wire frame to allow the paper to smoothly slide over the length of the ramps without catching or jamming. In the displayed embodiment of the invention, sheet metal sides 25 and 26 are fitted along the length of the paper passage to restrict the sheets of paper from leaving the paper passage before entering the radiused ramp.

The receiving tray 5 is supported by a plurality of springs 9 which maintain the height of the top of the stack of paper in the receiving tray substantially constant relative to the discharge end of the radiused ramp. Accordingly, as indicated by the arrow 52 in FIG. 3, the springs 9 allow the receiving tray 5 to descend in a linear relation to the weight of the paper stack 51 in the receiving tray 5. The receiving tray 5 is constructed of wire to allow the paper to smoothly slide into a stack on the receiving tray 5.

The exit end 32 of the radiused ramp 3 is provided with a plurality of fingers 4 that contact the sheets of paper as they pass the fingers end of the radiused ramp. The fingers help to define a paper fall path between the exit end of the radiused ramp and the paper stack 51 in the receiving tray 5. The fingers 4 act to regulate the speed and path of the individual sheets of paper and to prevent the sheets of paper from forming an uneven paper stack. Each of the individual fingers is preferably made from a strong enough grade of steel so as to be relatively resistant to deformation through continued use, so that the sheets of paper will slide smoothly over the length of the finger 4. Spring steel has shown to adequately serve this purpose.

Sheet metal sides 9 are attached to the wire frame of the stacker to cover the springs and further define the paper receiving area. In addition a plurality of casters 10 are provided to allow for improved movement of the passive paper stack between various locations.

Not pictured, but included in alternative embodiments are the following. An alignment bar for first attaining the proper alignment with the paper output of the printing device and then holding the stacker unit in proper alignment with the paper output of the printing device. A brake for stopping the stacker from moving or shifting when it is in use. The brake has proven especially useful when the casters are added to the stacker. A shelf, preferably made from plastic or metal, that rests in the paper receiving tray, such that when paper has been stacked in the receiving tray, the shelf may be removed with the stack of paper resting on top of it.

Thus, the invention provides a practical and useful device which may be economically manufactured, and which meets a need in the industry for simplicity and utility. Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

Having hereby described our invention, I claim:

1. A passive paper stacker for stacking paper outputted from a printing device, the device having a paper output on the front, rear or sides of the device, and the sheets of printed paper outputted in a horizontal plane from the device and oriented with printed sides facing vertically above the plane, the stacker comprising:

a slide ramp, having a proximal end and a distal end, said slide ramp receiving paper from a printing device at the proximal end and being oriented so that the force of gravity acting on the paper will tend to pull the paper from the proximal end to the distal end; and a radiused ramp, having an entry end and a discharge end, receiving at the entry end sheets of paper, having a given side facing up, from the slide ramp, and discharging at the discharge end the sheets of paper with the opposite side facing up.

2. The passive paper stacker of claim 1, further comprising:

a receiving tray receiving sheets of paper from the discharge end of the radiused ramp.

3. The passive paper stacker of claim 2, further comprising:

a tray positioning means adapted to maintain the receiving tray in such a position that the distance from the top sheet of paper in the receiving tray to the discharge end of the radiused ramp remains substantially constant as successive sheets of paper are stacked in the receiving tray.

4. The passive stacker of claim 2, further comprising a plurality of fingers for regulating the speed with which sheets of paper exit the discharge end of the radiused ramp.

5. The passive paper stacker of claim 4, wherein the fingers are constructed from sheet metal or spring steel.

6. The passive stacker of claim 1, wherein the slide ramp and radiused ramp are constructed from a wire frame.

7. The passive stacker of claim 3, wherein the tray positioning means are a plurality of springs.

8. The passive paper stacker of claim 2, further comprising a receiving tray shelf fitting between the receiving tray and the sheets of paper entering the receiving tray.

9. The passive paper stacker of claim 1, further comprising side pieces adapted to substantially cover the sides of the paper stacker.

10. The passive paper stacker of claim 9, wherein the side pieces are made of sheet metal.

11. The passive paper stacker of claim 1, further comprising an alignment bar means adapted to maintain the passive paper stacker in alignment with the printing device.

12. The passive paper stacker of claim 1, further comprising a brake means adapted to retard any motion of the paper stacker while in use.

* * * * *